US009261096B2

(12) United States Patent
Lin

(10) Patent No.: US 9,261,096 B2
(45) Date of Patent: Feb. 16, 2016

(54) PUMP MOTOR COMBINATION

(75) Inventor: Chih M. Lin, Tipp City, OH (US)

(73) Assignee: Regal Beloit America, Inc., Beloit, WI (US)

( * ) Notice: Subject to any disclaimer, the term of this patent is extended or adjusted under 35 U.S.C. 154(b) by 380 days.

(21) Appl. No.: 13/482,334

(22) Filed: May 29, 2012

(65) Prior Publication Data

US 2013/0028760 A1 Jan. 31, 2013

Related U.S. Application Data

(60) Provisional application No. 61/513,161, filed on Jul. 29, 2011.

(51) Int. Cl.

| | |
|---|---|
| ***F04B 35/04*** | (2006.01) |
| ***F04D 7/06*** | (2006.01) |
| ***F04D 13/08*** | (2006.01) |
| ***F04D 29/42*** | (2006.01) |

(52) U.S. Cl.
CPC ..... *F04D 7/06* (2013.01); *F04D 13/086* (2013.01); *F04D 29/4286* (2013.01)

(58) Field of Classification Search
CPC ..... F04D 7/06; F04D 13/086; F04D 29/4286
USPC ..... 417/410.1, 406
See application file for complete search history.

(56) References Cited

U.S. PATENT DOCUMENTS

| | | | | |
|---|---|---|---|---|
| 2,611,930 | A | | 9/1952 | Hill et al. |
| 3,010,401 | A | | 11/1961 | Granqvist |
| 3,398,687 | A | | 8/1968 | Yoshikawa |
| 3,936,243 | A | | 2/1976 | Gakenholz |
| 4,445,820 | A | | 5/1984 | Hayashi et al. |
| 4,451,213 | A | | 5/1984 | Takei et al. |
| 4,493,620 | A | | 1/1985 | Takei et al. |
| 4,586,877 | A | | 5/1986 | Watanabe et al. |
| 4,966,532 | A | | 10/1990 | Fengsheng |
| 4,981,420 | A | | 1/1991 | Jensen et al. |
| 5,028,218 | A | | 7/1991 | Jensen et al. |
| 5,173,022 | A | | 12/1992 | Sango |
| 5,261,796 | A | * | 11/1993 | Niemiec et al. ..... 417/371 |
| 5,490,319 | A | | 2/1996 | Nakamura et al. |
| 5,549,447 | A | | 8/1996 | Bevington |
| 5,700,138 | A | | 12/1997 | Bevington |
| 5,806,169 | A | | 9/1998 | Trago et al. |
| 5,823,751 | A | | 10/1998 | Sjoblom et al. |
| 5,833,437 | A | | 11/1998 | Kurth et al. |
| 6,012,909 | A | * | 1/2000 | Sloteman et al. ..... 417/366 |

(Continued)

FOREIGN PATENT DOCUMENTS

| | | |
|---|---|---|
| DE | 4220554 | 1/1994 |

*Primary Examiner* — Justin Jonaitis
*Assistant Examiner* — Stephen Mick
(74) *Attorney, Agent, or Firm* — Michael Best & Friedrich LLP

(57) ABSTRACT

A pumping apparatus includes a housing having an inlet at a first end and an outlet at an opposite second end. An encapsulated stator defines an opening and is supported by the housing. A pressure plate includes diffuser vanes formed as part of the pressure plate. The pressure plate is formed as part of the encapsulated stator. A rotor is positioned at least partially within the opening and is rotatable with respect to the stator and an impeller is coupled to the rotor and cooperates with the pressure plate and the housing to pump a fluid from the inlet to the outlet in response to rotation of the rotor.

22 Claims, 5 Drawing Sheets

(56) References Cited

U.S. PATENT DOCUMENTS

| | | | | |
|---|---|---|---|---|
| 6,020,661 | A | 2/2000 | Trago et al. | |
| 6,579,077 | B1 * | 6/2003 | Bostwick et al. | 417/366 |
| 6,666,664 | B2 | 12/2003 | Gross | |
| 6,692,225 | B2 | 2/2004 | Lin | |
| 6,739,844 | B1 | 5/2004 | Yu et al. | |
| 6,832,901 | B2 | 12/2004 | Kuchn et al. | |
| 7,014,432 | B2 | 3/2006 | Iwanari | |
| 7,048,518 | B2 | 5/2006 | Oliveira et al. | |
| 7,048,520 | B1 | 5/2006 | McCarthy | |
| 7,118,354 | B2 | 10/2006 | Kenney et al. | |
| 2003/0002996 | A1 | 1/2003 | Pace et al. | |
| 2003/0124005 | A1 | 7/2003 | Bostwick et al. | |
| 2004/0076532 | A1 | 4/2004 | Miyazaki et al. | |
| 2004/0247467 | A1 | 12/2004 | Ito et al. | |
| 2004/0253125 | A1 * | 12/2004 | Kobayashi et al. | 417/410.1 |
| 2005/0069435 | A1 | 3/2005 | Ikeya et al. | |
| 2005/0226751 | A1 | 10/2005 | Meyers et al. | |
| 2005/0263935 | A1 * | 12/2005 | Aisenbrey | 264/115 |
| 2006/0013712 | A1 | 1/2006 | Lee et al. | |
| 2006/0024176 | A1 | 2/2006 | Ikeya | |
| 2006/0120904 | A1 | 6/2006 | Haesloop | |
| 2009/0155100 | A1 * | 6/2009 | Genster | 417/410.1 |
| 2009/0191072 | A1 * | 7/2009 | Kendall | 417/410.1 |
| 2009/0202368 | A1 * | 8/2009 | Ito | 417/410.1 |
| 2009/0285678 | A1 * | 11/2009 | Brunner et al. | 415/199.3 |
| 2010/0034674 | A1 * | 2/2010 | Oota et al. | 417/410.1 |
| 2010/0119363 | A1 * | 5/2010 | Sagoo et al. | 415/198.1 |

* cited by examiner

PUMP MOTOR COMBINATION

CROSS-REFERENCE TO RELATED APPLICATIONS

This application claims priority to U.S. Provisional Application No. 61/513,161, filed Jul. 29, 2011, the content of which is incorporated herein by reference in its entirety.

BACKGROUND

The invention relates to a combined motor and pump assembly. More specifically, the invention relates to a combined motor and multi-stage pump assembly configured to be positioned within a pipe.

In some applications, it is desirable to position a pump and motor within the fluid being pumped. However, this can shorten the life of many of the pump and motor components as some fluids present a corrosive environment for materials typically used to manufacture pumps and motors.

SUMMARY

In one embodiment, the invention provides a pumping apparatus that includes a housing having an inlet at a first end and an outlet at an opposite second end. An encapsulated stator defines an opening and is supported by the housing. A pressure plate includes diffuser vanes formed as part of the pressure plate. The pressure plate is formed as part of the encapsulated stator. A rotor is positioned at least partially within the opening and is rotatable with respect to the stator and an impeller is coupled to the rotor and cooperates with the pressure plate and the housing to pump a fluid from the inlet to the outlet in response to rotation of the rotor.

In another embodiment, the invention provides a pumping apparatus that includes a housing defining an inlet and an outlet and a plurality of diffuser vanes formed as part of the housing and positioned adjacent the inlet. A stator defines an opening and is supported within the housing. An encapsulant is formed around the stator and includes a pressure plate at a first end and positioned adjacent the inlet. A rotor is positioned at least partially within the opening and is rotatable with respect to the stator and an impeller is coupled to the rotor and cooperates with the pressure plate and the diffuser vanes to pump a fluid from the inlet to the outlet in response to rotation of the rotor.

The invention also provides a pumping apparatus that includes a housing having an inlet, an outlet and an interior space between the inlet and the outlet. A motor is positioned in the interior space and includes a rotor positioned adjacent a stator and rotatable with respect to the stator. The stator is substantially surrounded by an encapsulation that defines a pressure plate. A pump is positioned in the interior space and is coupled for rotation with the rotor. The pump includes a first stage impeller positioned adjacent the inlet and a last stage impeller positioned adjacent the pressure plate. The pump is operable in response to rotor rotation to move a fluid from the inlet to the outlet.

Other aspects and embodiments of the invention will become apparent by consideration of the detailed description and accompanying drawings.

BRIEF DESCRIPTION OF THE DRAWINGS

The detailed description particularly refers to the accompanying figures in which.

DETAILED DESCRIPTION

Before any embodiments of the invention are explained in detail, it is to be understood that the invention is not limited in its application to the details of construction and the arrangement of components set forth in the following description or illustrated in the following figures. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings. In addition, where a method, process, or listing of steps is provided, the order in which the method, process, or listing of steps is presented should not be read as limiting the invention in any way.

Figure 1:
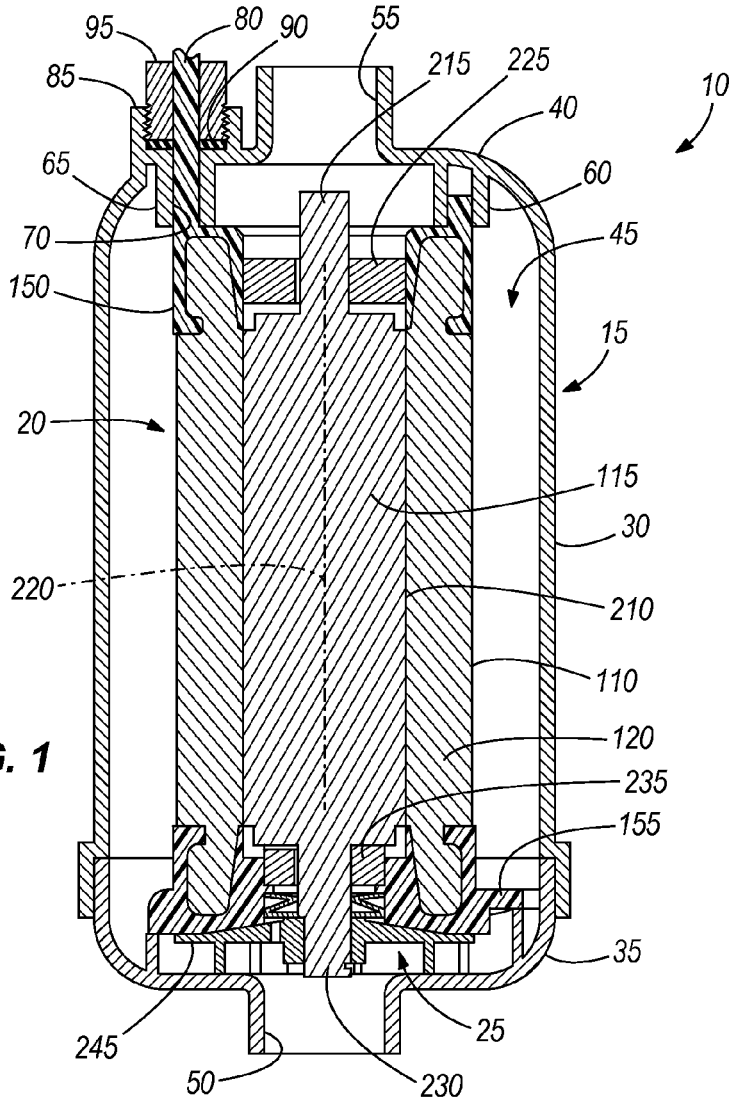
FIG. 1 is a section view of a combined motor and pump assembly taken along an axis of rotation of the motor and pump.

FIG. 1 illustrates a pumping apparatus 10 in section view. The pumping apparatus 10 includes a housing 15 that substantially encloses a motor 20 and a pump 25 attached to the motor 20. The housing 15 includes a substantially cylindrical outer wall 30, an inlet end cap 35, and an outlet end cap 40 that cooperate to substantially enclose an interior space 45. An inlet aperture 50 is formed in the inlet end cap 35 and an outlet aperture 55 is formed in the outlet end cap 40. In the illustrated construction, the inlet end cap 35 is removable to provide access to the interior space 45 to allow for the insertion and removal of the motor 20 and the pump 25, while the outlet end cap 40 is formed as part of the cylindrical outer wall 30. In other constructions, the inlet end cap 35 is formed as part of the cylindrical outer wall 30 or both the inlet end cap 35 and the outlet end cap 40 are removably attached to the cylindrical outer wall 30.

The housing 15 includes a support boss 60 formed as part of the outlet end cap 40 and arranged to support the motor 20 in an operating position. A cord boss 65 extends inward around a cord aperture 70. A power cord 80 passes through the cord aperture 70 to provide power to the motor 30. An outer boss 85 is formed on the outer surface of the housing 15 to allow for the passage of the power cord 80 out of the housing 15. A cord seal 90 and packing nut 95 are received within the outer boss 85 to define a seal and inhibit fluid leakage from the power cord opening. The packing nut 95 is tightened to compress the seal 90 against the outer boss 85 and the cord 80 to form the desired seal.

Figure 2:
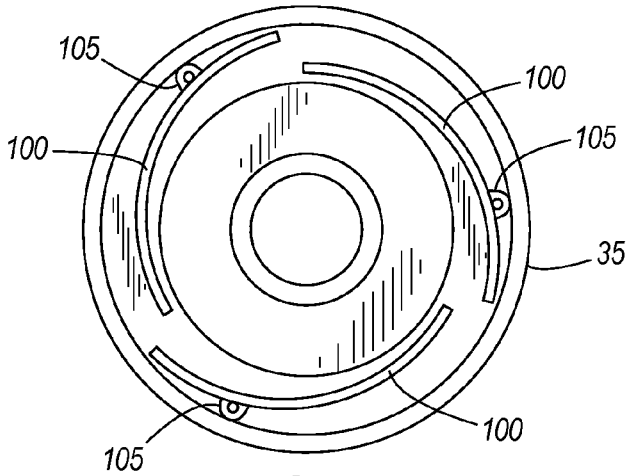
FIG. 2 is an end view of an inside of a housing for the combined motor and pump assembly of FIG. 1.

As illustrated in FIG. 2, the inlet end of the housing 15 includes a plurality of diffuser vanes 100 arranged around the inlet aperture 50. The diffuser vanes 100 also include attachment points 105 that facilitate the attachment of the motor 20 to the housing 15 as will be discussed.

Returning to FIG. 1, the motor 20 includes a stator 110 and a rotor 115 positioned adjacent the stator 110 and rotatable with respect to the stator 110. The stator 110, illustrated in FIG. 3 includes a plurality of windings 120 (one shown in section) arranged to define a central opening 125 that is sized to receive the rotor 115 and an encapsulation 130 that substantially surrounds the stator 110. The encapsulation 130, illustrated in FIG. 3 includes a first encapsulant 135 positioned or formed around the stator 110 to insulate the windings 120 of the stator 110. In some constructions, a stainless steel foil 140 is positioned along the central opening 125 of the stator 110. The stator 110 and the stainless steel foil 140 are then positioned within a mold and the first encapsulant 135 is injection molded into the stator 110. The first encapsulant 135 thus attaches the stainless steel foil 140 to the stator 110, fills in spaces within the stator 110 to hold the windings 120 in the desired position and acts as a binder to hold the windings 120 together. In some constructions, the stainless steel foil 140 is positioned around the outside diameter, as well as in the central opening 125 of the stator 110 to further protect the stator 110 from corrosion initiated by contact with the fluid being pumped. It should be noted that FIG. 3 shows the foil and first encapsulant 135 as being relatively thick compared to the winding 120 for illustrative purposes only.

The encapsulation 130 also includes a second encapsulant 145 formed around the stator 110 to enhance the structural capabilities of the stator 110 and to improve the thermal conductivity properties of the stator 110. The second encapsulant 145 defines a first end cap 150 that covers the end windings on an end of the stator 110 nearest the outlet end cap 40 and a second end cap 155 that covers the end windings on the end of the stator 110 nearest the inlet end cap 35. The first end cap 150 surrounds the power cord 80 and defines a boss 160 that fits within the boss aperture 75 of the cord boss 65. Another boss 165 formed as part of the outlet end cap 40 engages the support boss 60 to position the stator 110 and the rotor 115 in the proper position with respect to the housing 15.

Figure 4:
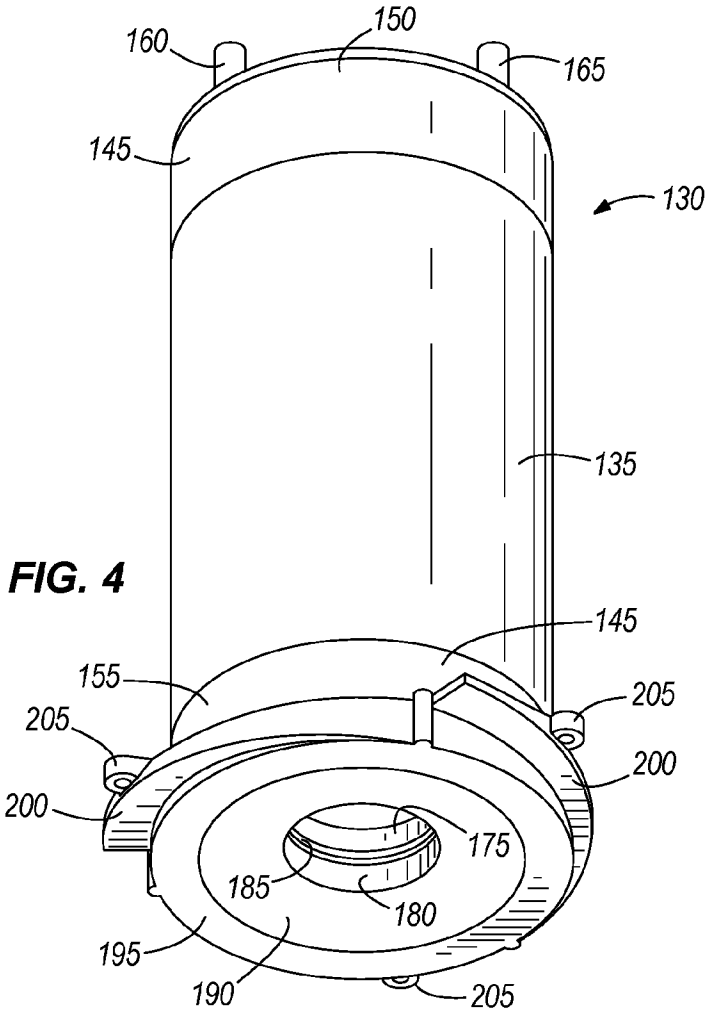
FIG. 4 is a perspective view of the combined motor and pump of FIG. 1.
Figure 3:
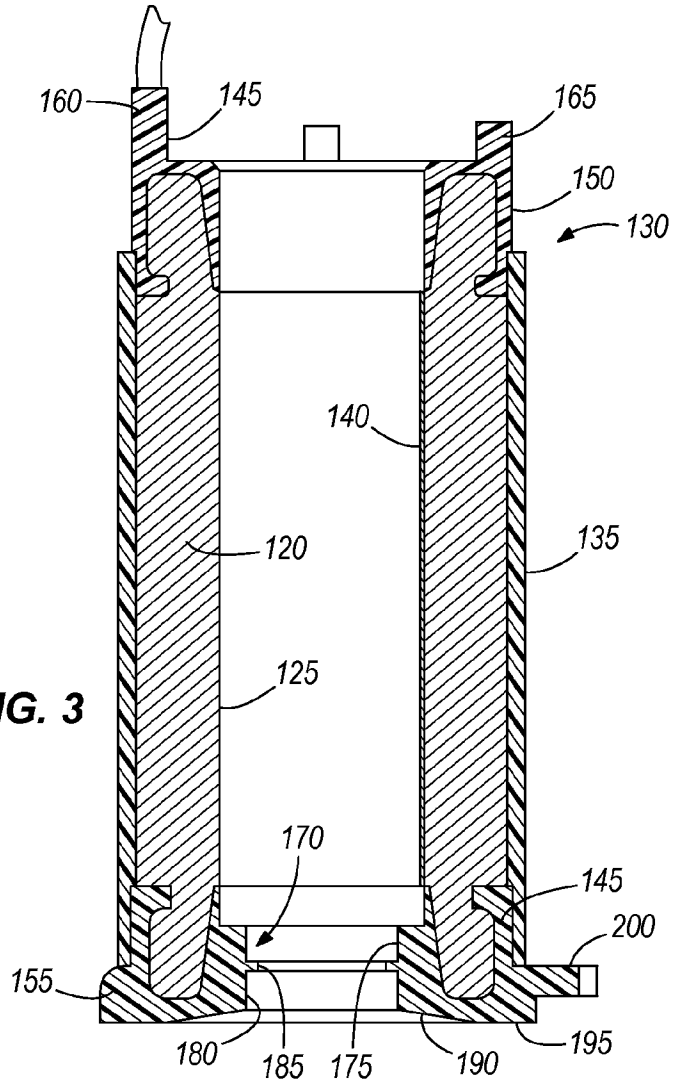
FIG. 3 is a section view of a stator of the motor of FIG. 1.

The second end cap 155, illustrated in FIGS. 3 and 4, includes an inner cylindrical surface 170 that is divided into a bearing surface 175 and a thrust surface 180 by a rabbit fit 185 that extends radially inward from the cylindrical surface 170. The bottom of the second end cap 155 includes a frustoconical surface 190 and a planar surface 195 positioned radially outward of the frustoconical surface 190 that cooperate to define a pressure plate. A plurality of diffuser vanes 200 are formed as part of the second end cap 155 and serve to guide fluid in a desired direction after it is discharged from the pump 25. A portion of the diffuser vanes 200 includes an attachment flange 205 that facilitates the attachment of the motor 20 to the housing 15. In the illustrated construction, the attachment flange 205 includes an aperture sized for the passage of a fastener (not shown). The fastener engages the attachment points 105 of the inlet end cap 35 to attach the motor 20 and pump 25 to the housing 15.

With reference to FIG. 1, the rotor 115 includes a cylindrical body 210 that is sized to fit within the central opening 125. A first shaft portion 215 extends along a rotational axis 220 toward the outlet 55. A first bearing 225 has an inner aperture that engages the first shaft portion 215 and an outer surface that engages the first end cap 150. A second shaft portion 230 extends along the rotational axis 220 toward the inlet aperture 50. A second bearing 235 includes an inner opening that engages the second shaft portion 230 and an outer surface that engages the second end cap 155 at the bearing surface 175. Thus, the first bearing 225 and the second bearing 235 support the rotor 115 for rotation about the rotational axis 220. In the illustrated construction, roller bearings are employed. However, other constructions may include needle bearings, ball bearings, journal bearings or the like.

Figure 6:
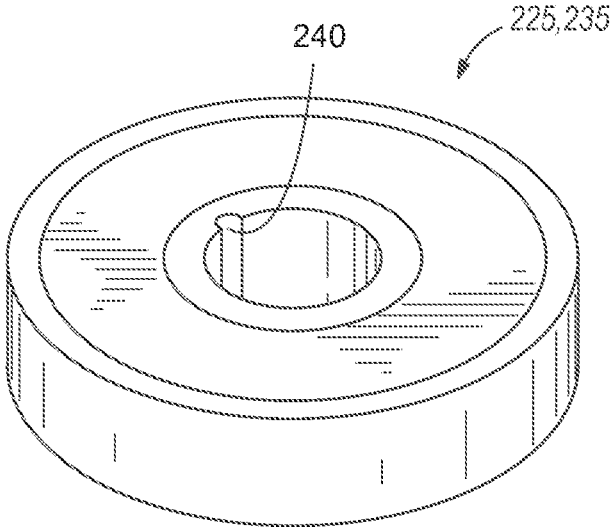
FIG. 6 is a perspective view of a seal member.

FIG. 6 illustrates a bearing 225, 235 that could be used as either the first bearing 225 or the second bearing 235. As can be seen, the bearing 225, 235 is a typical roller bearing having an inner race, an outer race, and a plurality of rollers positioned between the races. A bearing groove 240 is formed axially along the inner race to allow fluid to pass through the bearing 225, 235 to cool and lubricate the bearing 225, 235 as will be discussed.

Figure 5:
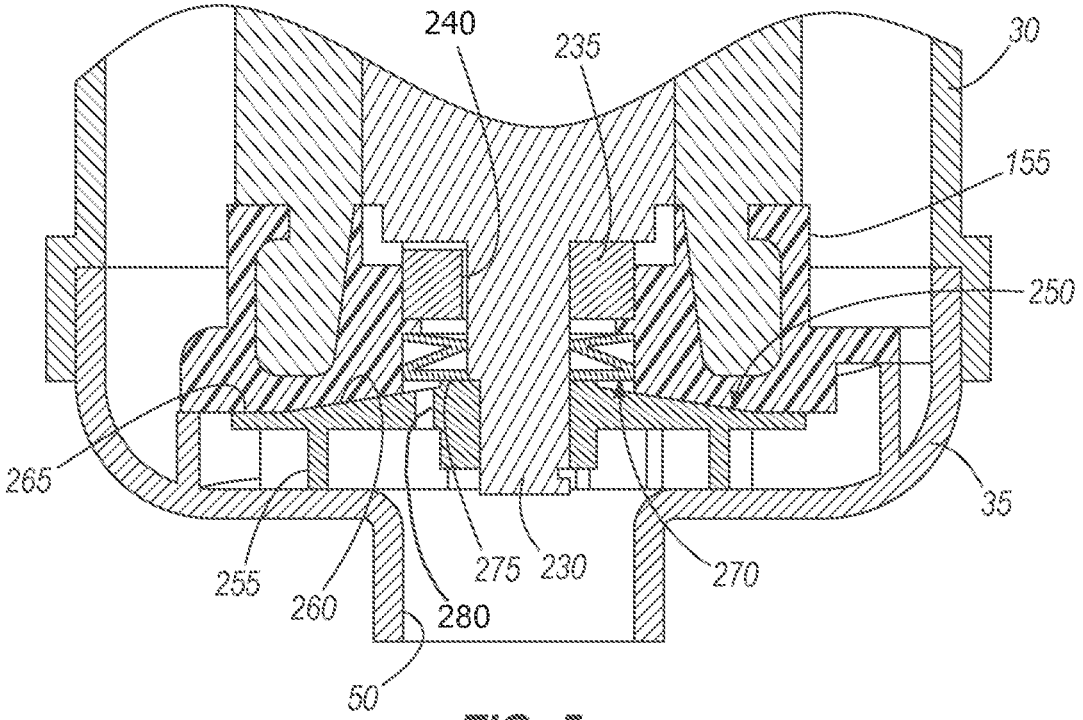
FIG. 5 is an enlarged section view of the pump of the combined motor and pump of FIG. 1.

The pump 25, best illustrated in FIG. 5 attaches to the second shaft portion 230 and includes an impeller 245 having a backface 250 and a plurality of vanes 255. The backface 250 includes a frustoconical portion 260 and a planar portion 265 disposed radially outward of the frustoconical portion 260. The backface 250 corresponds to the bottom surface 190, 195 of the second end cap 155 and cooperates with the bottom surface 190, 195 to form a partial seal therebetween. The plurality of vanes 255 cooperates with the vanes 100 of the housing 15 to form a plurality of channels that operate to pump a fluid in response to rotation of the impeller 245. The pump 25 operates in much the same way as a conventional centrifugal pump or scroll pump. In preferred constructions, the impeller 245 is permanently attached (i.e., not removal without damaging or destroying components) to the second shaft portion 230 (e.g., bonded, welded, brazed, soldered, etc.) with other constructions employing non-permanent attachment schemes (e.g., pins, splined shafts, threaded, etc.).

A thrust bearing 270, illustrated in FIG. 5 is positioned adjacent the thrust surface 180 of the second end cap 155 to accommodate the thrust load produced by the pump 25 during operation. The thrust bearing 270 includes a biasing member 275 (e.g., coil spring, Bellville washers, etc.) that engages the rabbit fit 185 at one end and the pump 25 at the opposite end. Of course other constructions could use other types of thrust bearings 270 or could combine the function of one of the first bearing 225 and the second bearing 235 with the function of the thrust bearing 270 by using a single combined rotary and thrust bearing capable of supporting the rotor 115 for rotation and supporting a thrust load.

To assemble the pumping apparatus 10, the stator windings 120 are positioned on a support structure. Once wound, the windings and support structure are positioned in a mold. Typically, the mold includes a core wrapped with the stainless steel foil 140. The first encapsulant 135 is injection molded into the windings 120 to seal and insulate the windings 120 and to hold the stainless steel foil 140 against the windings 120. The windings 120, the first encapsulant 135, and the mold core are then positioned within a second mold and the second encapsulant 145 is injected into the second mold to complete the stator 110 (as illustrated in FIG. 4). Leaving the mold core in the partially completed stator 110 assures that the core will be properly positioned in the second mold.

The rotor 115 is next positioned within the stator 10. The first bearing 225 and the second bearing 235 are positioned to engage the rotor 115 and the stator 110 to support the rotor 115 for rotation. Next, the thrust bearing 270 is positioned on the second shaft portion 230 and the pump impeller 245 is positioned against the second shaft portion 230 and welded or otherwise attached. The inlet end cap 35 is next attached to the stator 110. The attachment points 105 of the housing vanes 100 are aligned with the attachment flange 205 of the vanes 200 of the inlet end cap 35 and fasteners are used to complete the attachment.

The inlet end cap 35 is moved into engagement with the cylindrical outer wall 30 of the housing 15 as the power cord 80 is pulled through the aperture 75. The inlet end cap 35 is then attached to the cylindrical outer wall 30 of the housing 15. In one construction, the inlet end cap 35 is welded in place with other constructions using a threaded connection. The packing nut 95 is then tightened to complete the assembly of the pumping apparatus 10.

In one construction, the pumping apparatus 10 is used as a submersible water pump. In operation in this construction, power is provided to the motor 20 to rotate the rotor 115 and the impeller 245. Water is drawn into the impeller 245 through the inlet aperture 50 and is pumped toward the outlet aperture 55. Water is able to pass through the impeller 245 (via a bleed aperture 280) and some water may pass between the pressure plate 190, 195 and the backface 250 and to the bearing groove 240 to cool the second bearing. Water continues to flow between the cylinder outer wall 30 and the stator 110 toward the outlet aperture 55. Water is able to flow to the first bearing 225 and through the bearing groove 240 to cool and lubricate the first bearing 225 before it is ultimately discharged from the pump 25 through the outlet aperture 55.

Figure 7:
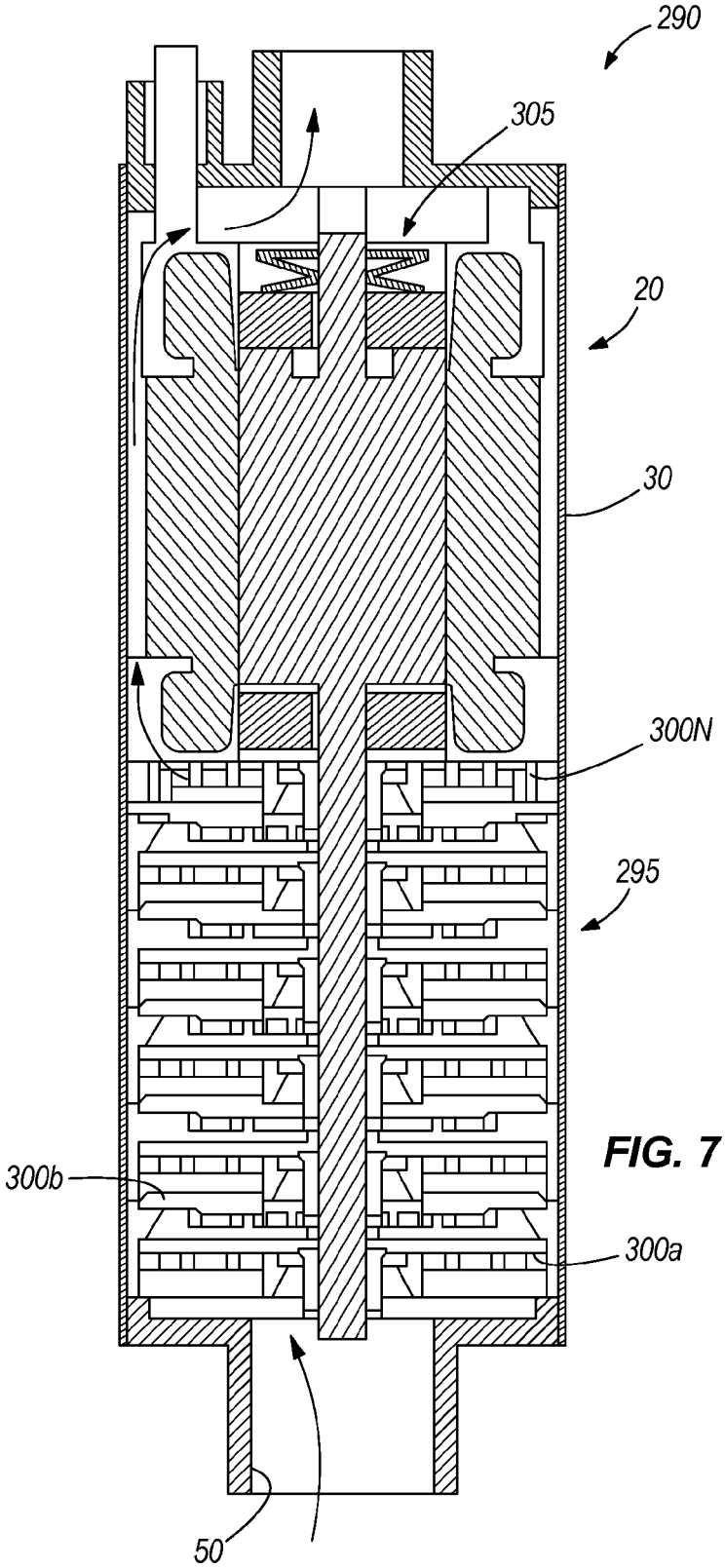
FIG. 7 is a section view of a combined motor and multi-stage pump assembly taken along an axis of rotation of the motor and pump.

FIG. 7 illustrates another construction of a pumping apparatus 290 in which the single stage impeller 245 is replaced by a multi-stage pump 295 including a plurality of impellers 300. A first stage impeller 300*a* draws fluid in through the inlet aperture 50 as has been described, and passes the fluid to the next successive stage 300*b*. The final stage 300*n* (adjacent the motor 20) discharges the fluid into the cylindrical outer wall 30 much like the construction of FIGS. 1-6. The additional stages allow the pump 295 to discharge at a higher overall pressure ratio, thereby allowing the pump 295 to pump water or other fluids to a higher level or to a higher pressure.

The construction of FIG. 7 also illustrates a thrust bearing 305 positioned at the opposite end of the motor 20 when compared to the construction of FIG. 1. As one of ordinary skill will understand, there are many different arrangements of bearings and thrust bearings, as well as other components that are possible. As such, the invention should not be limited to the constructions illustrated herein.

Figure 8:
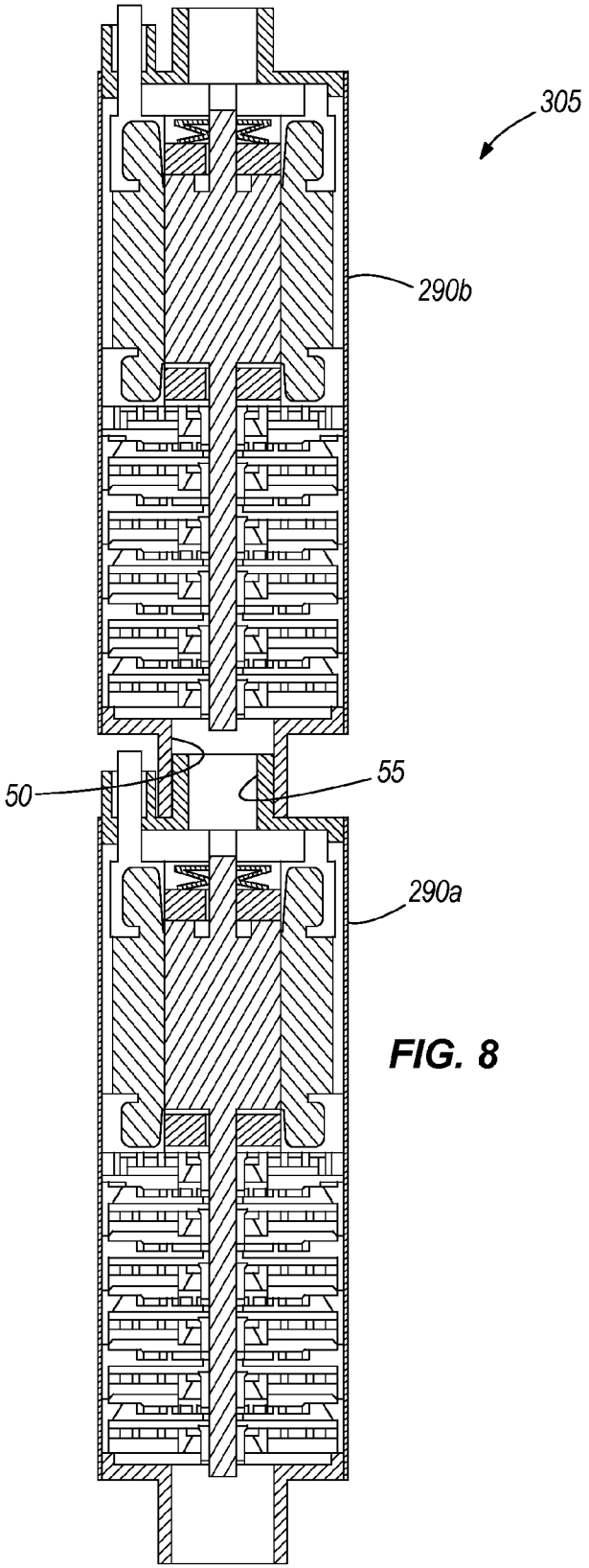
FIG. 8 is a section view of two combined motor and multi-stage pump assemblies of FIG. 7 arranged in series.

FIG. 8 illustrates another construction of a pumping apparatus 305 in which two pumping assemblies 290 such as those illustrated in FIG. 7 are arranged in series to further enhance the pressure ratio, outlet pressure, or overall pumping capability of the system. In this construction, the outlet aperture 55 of the first pumping apparatus 290*a* is connected to the inlet aperture 50 of the second pumping apparatus 290*b*. As one of ordinary skill will realize, more than two pumping apparatus 290 or different arrangements of the pumping apparatus 10, 290 could be arranged in series as desired. For example, in another construction, the single stage arrangement of FIG. 1 is combined in series with the multi-stage arrangement of FIG. 7. In still other constructions, three or more assemblies are arranged in series.

Thus, the invention provides, among other things, a new and useful pumping apparatus 10, 290, 305 for pumping fluid. The constructions of the pumping apparatus 10, 290, 305 and the methods of manufacturing the pumping apparatus 10, 290, 305 described herein and illustrated in the figures are presented by way of example only and are not intended as a limitation upon the concepts and principles of the invention.

I claim:

1. A pumping apparatus comprising:

a housing having an inlet at a first end and an outlet at an opposite second end;

a stator including a plurality of windings and defining an opening and supported by the housing;

an encapsulation including a first end cap and a second end cap formed into the stator such that the encapsulation fills some of the spaces within the stator to hold the plurality of windings in a desired position, the encapsulation and the stator cooperating to at least partially define an encapsulated stator;

a pressure plate including diffuser vanes formed as part of the pressure plate, the pressure plate formed as one continuous homogeneous component of the first end cap of the encapsulation;

a rotor positioned at least partially within the opening and rotatable with respect to the stator;

a first bearing directly supported by the encapsulation;

a second bearing directly supported by the encapsulation, the first bearing and the second bearing cooperating to support the rotor for rotation; and an impeller coupled to the rotor and cooperating with the pressure plate and the housing to pump a fluid from the inlet to the outlet in response to rotation of the rotor, the fluid in direct contact with a portion of the encapsulation as it flows between the inlet and the outlet.

2. The pumping apparatus of claim 1, further comprising a plurality of diffuser vanes formed as part of the housing and positioned adjacent the inlet.

3. The pumping apparatus of claim 1, wherein the first end cap covers a first end of the stator and a second end cap covers a second end of the stator, and a second encapsulant covers an outer surface of the stator between the first end cap and the second end cap.

4. The pumping apparatus of claim 3, wherein the first end cap uses a first material and the second encapsulant uses a second material different from the first material.

5. The pumping apparatus of claim 4, wherein one of the first material and the second material is an insulative material and the other of the first material and the second material is a thermal conductor.

6. The pumping apparatus of claim 1, wherein the impeller is of a design suitable for use in a scroll compressor.

7. The pumping apparatus of claim 1, wherein the fluid flows past the stator to cool the stator.

8. A pumping apparatus comprising:

a housing defining an inlet and an outlet;

a plurality of diffuser vanes formed as part of the housing and positioned adjacent the inlet;

a stator defining an opening and supported within the housing;

a first encapsulant formed as a single continuous homogeneous component around a first end of the stator and including a pressure plate at a first end positioned adjacent the inlet, the first encapsulant in direct contact with the stator windings to at least partially support and bind the windings;

a rotor positioned at least partially within the opening and rotatable with respect to the stator;

a first bearing directly supported by the first encapsulant;

a second encapsulant formed as a single continuous homogeneous component around a second end of the stator;

a second bearing directly supported by the second encapsulant, the first bearing and the second bearing cooperating to support the rotor for rotation; and an impeller coupled to the rotor and cooperating with the pressure plate and the diffuser vanes to pump a fluid from the inlet to the outlet in response to rotation of the rotor.

9. The pumping apparatus of claim 8, wherein the stator includes a third encapsulant that covers an outer surface of the stator between the first end and the second end.

10. The pumping apparatus of claim 9, wherein the first encapsulant and the second encapsulant uses a first material and the third encapsulant uses a second material different from the first material.

11. The pumping apparatus of claim 10, wherein one of the first encapsulant and the third encapsulant is an insulative material and the other of the first encapsulant and the second encapsulant is a thermal conductor.

12. The pumping apparatus of claim 8, wherein the impeller is of a design suitable for use in a scroll compressor.

13. The pumping apparatus of claim 8, wherein the fluid flows past the stator to cool the stator.

14. A pumping apparatus comprising:

a housing including an inlet, an outlet and an interior space between the inlet and the outlet;

a motor positioned in the interior space and including a rotor positioned adjacent a stator and rotatable with respect to the stator, the stator including windings substantially surrounded by an encapsulation that defines a pressure plate;

an encapsulation that defines a first end cap and a second end cap, the first end cap substantially surrounding and formed into the stator such that the first end cap fills some of the spaces within the stator to hold the windings in a desired position relative to one another, the first end cap further defining a pressure plate, the first end cap formed as a single continuous and homogeneous component;

a bearing directly supported by the first end cap and operable to at least partially support the rotor for rotation; and a pump positioned in the interior space and coupled for rotation with the rotor, the pump including a first stage impeller positioned adjacent the inlet and a last stage impeller positioned adjacent the pressure plate, the pump operable in response to rotor rotation to move a fluid from the inlet to the outlet.

15. The pumping apparatus of claim 14, further comprising a plurality of diffuser vanes formed as part of the housing and positioned adjacent the inlet.

16. The pumping apparatus of claim 14, wherein the first end cap covers a first end of the stator and a second end cap covers a second end of the stator, and a second encapsulant that covers an outer surface of the stator between the first end cap and the second end cap.

17. The pumping apparatus of claim 16, wherein the first end cap uses a first material and the second encapsulant uses a second material different from the first material.

18. The pumping apparatus of claim 17, wherein one of the first material and the second material is an insulative material and the other of the first material and the second material is a thermal conductor.

19. The pumping apparatus of claim 14, wherein the first stage impeller and the last stage impeller are of a design suitable for use in scroll compressors.

20. The pumping apparatus of claim 14, wherein the fluid flows past the stator to cool the stator.

21. The pumping apparatus of claim 14, wherein the pump further includes at least one stage between the first stage and the last stage.

22. The pumping apparatus of claim 14, further comprising a second housing including a second pump and a second motor positioned within the second housing, the second pump and second motor being substantially the same as the pump and the motor, the outlet of the housing connected to an inlet of the second housing.

* * * * *